United States Patent [19]

Stegmeier

[11] 4,340,200

[45] Jul. 20, 1982

[54] SPRING CLIP AND MOLDING FORM UTILIZING SAME

[76] Inventor: William J. Stegmeier, 2525 E. Prince Rd., Apt. 72, Tuscon, Ariz. 85716

[21] Appl. No.: 97,375

[22] Filed: Nov. 26, 1979

[51] Int. Cl.[3] ..... E04G 17/00

[52] U.S. Cl. ..... 249/3; 249/6; 249/47; 249/168; 249/219 R

[58] Field of Search ..... 249/3, 6, 47, 168, 169, 249/219 R, 219 W; 264/31; 24/248, 249

[56] References Cited

U.S. PATENT DOCUMENTS

| | | | |
|---|---|---|---|
| 2,679,872 | 6/1954 | Sutcliffe | 249/219 W |
| 3,288,426 | 11/1966 | Simpson | 249/6 |
| 3,438,664 | 4/1969 | Meyer | 249/219 R |

*Primary Examiner*—John A. Parrish

*Attorney, Agent, or Firm*—C. Michael Zimmerman

[57] ABSTRACT

An apparatus for constructing a molding form for a concrete deck structure is disclosed. U-shaped spring clips secure flexible form boards to vertically anchored support stakes, with a flat side of each form board positioned along a desired border of the concrete. Each spring clip has a pair of arms spaced apart, each of which has a slot for receiving an anchored stake. The slots in the two arms are in registration to receive the anchored stake simultaneously, and appendages extend from the free end of each arm to hook onto a concrete form board and secure it to the anchored stake. Each spring clip includes a generally S-shaped flat spring defining a resilient wedge structure near its free end which transmits a spring force that holds the gripped form board firmly against the anchored stake.

22 Claims, 9 Drawing Figures

SPRING CLIP AND MOLDING FORM UTILIZING SAME

BACKGROUND OF THE INVENTION

The invention relates generally to molding forms and, more particularly, to an apparatus for constructing a molding form having an accurately located reference surface that establishes a border for the molded structure.

Molded structures formed along the surface of the ground, such as concrete decks, typically are constructed by preparing a firm bed upon which the deck is to rest. Border defining forms are provided for confining the uncured concrete mixture to a desired border contour. A concrete mixture is poured over the prepared bed to fill the form and the surface of the poured concrete troweled. After the concrete cures to a firm state, the forms are dismantled.

Two types of molding form structures have been used in constructing concrete decks; structures of wood form boards and stakes fastened together by nails, and structures of specially formed metal form boards and stakes held together by rigid metal wedges. The wood form structures are constructed by driving stakes into the ground at intervals along a stake line that follows the desired edge contour of the deck. Then, flexible form boards of wood, commonly referred to as bender boards, are placed against the stakes and fastened thereto by nailing. In most cases, the stakes are displaced by the force of nailing, making it virtually impossible to locate the reference surface of the bender board at the reference line for the border of the deck. In addition to not being able to locate the reference surface precisely, the manner of construction of such wood form structures causes rapid deterioration of the materials used. Repeated nailing weakens the wood bender boards and they frequently break during the assembling and dismantling of the forms. The low number of repeated uses of the wood bender boards and stakes and the consumption of nails is an expense of construction that is becoming increasingly significant with the rising costs of construction materials.

The metal type molding form structure includes a metal form board having a pair of apertured appendages extending perpendicularly from one side of a planar member, the opposite side of the planar member forming the reference surface. A support stake is inserted through apertures of the appendages and a separate rigid metal wedge is driven between the stake and the facing side of the metal form board. Driving the wedge forces the metal form board away from the support stake to cause the stake to bear forcefully against the wall of the apertures whereby the metal form board is held firmly in place relative to the support stake. A substantial force is required to drive the rigid wedge between the stake and the facing side of the form board and, frequently, the wedge galls the side and/or support stake. After many uses of the metal form boards and support stakes, galling often becomes so extensive that the metal form boards and/or support stakes are deteriorated beyond use. Even before the metal form boards and/or support stakes are deteriorated beyond use, galling may deform them to such an extent that accurate location of the reference surface that defines the border of the concrete deck is prevented. Consequently, the metal type molding form structures do not entirely alleviate the shortcomings of the previously described wood type. In addition, it is more costly to manufacture and use the metal form structures than their wood counterparts.

Accordingly, considerable advantage is to be gained by the use of inexpensive molding form components that are not easily damaged by repeated usage. Additional advantages are to be gained by the use of molding form components that permit commonly available bender boards to be used repeatedly.

SUMMARY OF THE INVENTION

The present invention is an apparatus for constructing molding forms characterized by the aforementioned and other advantages. Several advantages accruing to the apparatus of the present invention are realized because of the use of a U-shaped spring clip having a flat spring stressed to hold form boards in place. Other advantages are realized by using the U-shaped spring clips with a form board that has a pair of open channels lengthwise along one of its sides that are gripped by the spring clip.

More specifically, the U-shaped spring clip of the invention includes a generally U-shaped member that has a pair of spaced arms joined together at one of their respective ends by a web. Each of the arms extends from the web to a free end to join an appendage that extends transverse to the plane of the arm to define a hook latch. In use, the hook latch grips the form board at opposite sides of its longitudinal center line. To secure the form board in place relative to the support stake, a flat spring having a bend in its length is pivotally mounted at one of its ends to the spaced arms near the web to pass between the arms. Such flat spring has an unstressed span surface defined thereby permitting the spring to be positioned between the spaced arms and stressed to have its load bearing surface bear against the support stake with sufficient spring force to hold the form board firmly against the appendaged hook latches and in place relative to the support stake.

The U-shaped spring clip significantly lessens the impact forces imparted to the form boards and support stakes during assembly of the molding structure. The impact forces are lessened because the unstressed flat spring is resilient and has a bend in its length that permits the spring to be pivoted and forced into position by wedging its load bearing surface against the support stake along a path generally parallel to the form board. In dismantling the molding form, the form board is released from the support stake by disengaging the wedged spring, in a manner which does not impart significant force to the spring. This lessening of the impact forces avoids impairing the form boards and support stakes during assembly and disassembly of the molding form. Commonly available bender boards have been used repeatedly to construct concrete decks without causing noticeable damage and would last indefinitely if not for the deterioration of the wood caused by the moisture and corrosive materials contained in the concrete.

Wedging the spring in the above-described manner also facilitates the construction of a molding form with an accurately located border defining surface. The force component produced by the wedging action along a line normal to the form board is reduced to such an extent it is incapable of disturbing the position of a properly anchored support stake. Therefore, the line for anchoring the support stakes can serve as a reference for establishing the border defining reference line for the form boards. Moreover, the spring clips can be placed at differing positions as needed along the lengths of the anchoring stakes to set the form board at a desired grade.

The U-shaped spring clip has the additional advantage of permitting the use of commonly available bender boards and support stakes to achieve the above-described advantages. However, the construction of mold form is facilitated by using the spring clip with a form board having open channels longitudinally along one side of the form board opposite its reference surface, that can be gripped by the hook latches of the spring clip. These open channels permit the form board to be secured to anchored support stakes without the structural components of the clip contacting the reference surface or longitudinal edges of the form board. Thus the form can be dismantled without danger of damaging the molded structure. Moreover, the reference surface and longitudinal edges of the form board are free of undesirable obstructions which may interfere with surface finishing of the concrete.

The U-shaped spring clip also is instrumental in the method of constructing molding forms. In the method, stakes for supporting form boards are anchored in a bed serving as a support for the molded structure. The stakes are distributed at intervals along a stake line following the contour of the reference line defining the desired border contour of the structure to be molded. A U-shaped spring clip of the type described above is positioned with respect to each anchored stake by threading the stake through the registered apertures defined by the U-shaped spring clip. After threading by the stakes, form boards are positioned along and adjacent to the line of stakes between the spaced arms of the U-shaped spring clips. Each form board has a reference surface defined by one of its longitudinally extending sides that established the border of the molded structure. The form boards are positioned with their respective reference surfaces facing away from the anchored stakes. To secure the form boards in place relative to the anchored stake, the flat spring of each U-shaped spring clip is pivoted between the clip's arms to wedge the form board, the clip's hook latches, and the anchored stakes in place relative to each other. As a result of the placement of the anchored stakes, the reference surface defined by the wedged form board is automatically located at the desired position for the border to be constructed.

BRIEF DESCRIPTION OF THE DRAWINGS

The foregoing as well as other features and advantages of the apparatus of the present invention will become more apparent upon a consideration of the following detailed description and claims together with the accompanying drawings of which:

DETAILED DESCRIPTION OF THE PREFERRED EMBODIMENTS

Figure 1:
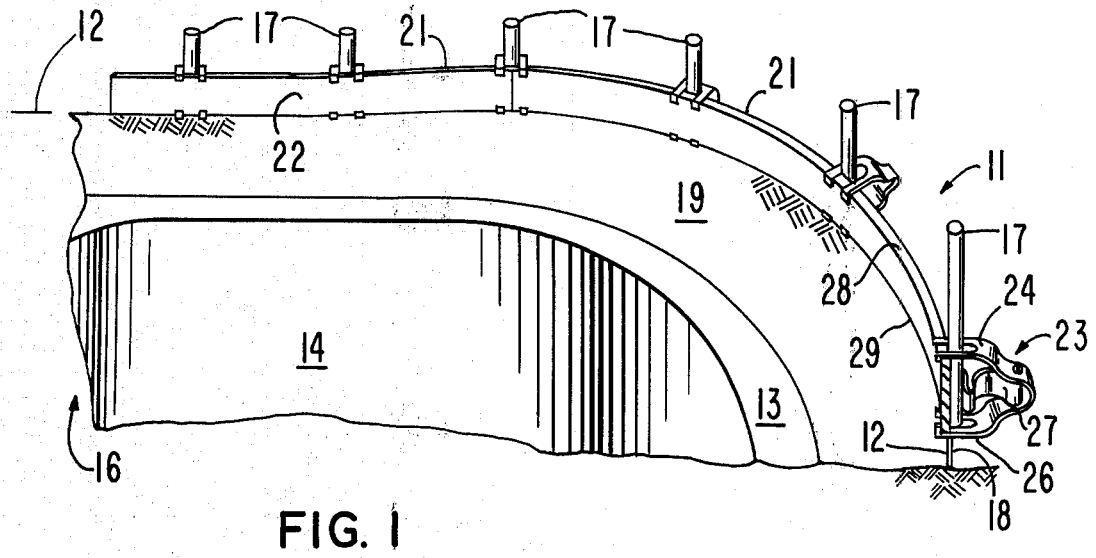
FIG. 1 is a perspective view of a portion of a molding form for constructing a concrete deck structure about a swimming pool.

The apparatus of the present invention will be described in detail as adapted to construct a molding form for a concrete deck structure for a swimming pool. A section of the molding form located adjacent a corner of the swimming pool is illustrated in FIG. 1. However, as will become more apparent from the following detailed description of the preferred embodiments of the invention, the apparatus can be adapted to construct molding forms for other concrete structures and for molded structures of materials other than concrete.

In constructing a concrete deck structure against a swimming pool coping, the molding form, generally identified by the reference number 11, is constructed to define all borders of the concrete deck structure 11 not abutting adjacent structures, such as the outer border of the concrete deck that is to extend along a desired reference line 12. The inner border of the deck abuts and is defined by the coping 13 of a constructed swimming pool and, therefore, a molding form is not required. As illustrated by FIG. 1, the coping 13 extends along the ground a short distance from the upwardly extending side wall 14 of the swimming pool 16 and is formed during the construction of the pool. Bordering concrete deck structures usually are constructed separately and after the pool construction.

The molding form 11 is constructed by anchoring support stakes 17 along a stake line 18 plotted along the ground 19 to follow the desired border contour of the concrete deck, but spaced from the desired border reference line 12 and located outside the area of the deck structure. The support stakes are anchored by driving them vertically into the ground 19 and are distributed along the stake line 18 at suitable intervals, depending on the length of the form boards and the contour of the outer border of the concrete deck structure.

To define the outer border of the concrete deck structure, the required form boards 21 are secured to the anchored support stakes 17 so that they are held firmly in place along the border reference line 12. At least one side 22 of each form board 21 is flat and is positioned along the border reference line 12 to form a reference surface facing towards and defining the outer border of the concrete deck structure. The widths of the form boards 21 are selected according to the thickness of the concrete deck structure to be constructed. Flat concrete decks and pedestrian paths typically are four inches thick and require molding forms 11 constructed with form boards that are four inches wide. Because concrete decks or other similar structures often have irregularly contoured borders as illustrated in FIG. 1, flexible form boards are used to construct molding forms. Wood bender boards are most commonly used to construct molding forms for concrete structures. However, more recently, flexible form boards have been fabricated from plastic materials.

In accordance with one aspect of the present invention, spring clips 23 of generally U-shaped configuration are employed to secure the form boards 21 in place relative to the anchored support stakes 17. Exemplary embodiments of the U-shaped spring clip useful in constructing molding forms in accordance with the present invention are illustrated in and will be described in detail hereinbelow with reference to FIGS. 2 through 5 and 9. In general, however, a single spring clip 23 is employed with each anchored support stake 17 to hold the form boards 21 securely in place relative to the anchored stakes. Each spring clip includes a pair of spaced apart flat arms 24 and 26 that cooperate with a curved flat spring 27 pivotally mounted between the arms to hold the form board 21 in place relative to the support stake 17. The pair of arms 24, 26 are arranged to grip the form board 21 along opposite longitudinal edges 28 and 29 with the curved flat spring 27 stressed to bear against the support stake 17. The stressed flat spring 27 generates a spring force that acts against the anchored stake 17 and the flat arms 24, 26 to hold the gripped form board 21 securely in place relative to the anchored stake.

Figure 6:
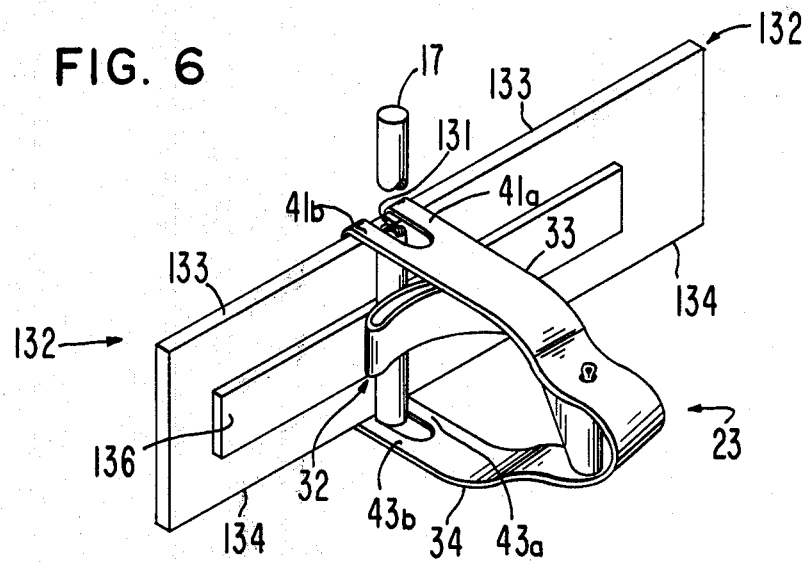
FIG. 6 is a perspective view of a portion of a molding form illustrating the use of a U-shaped spring clip and buttress to join the ends of adjacent form boards.
Figure 7:
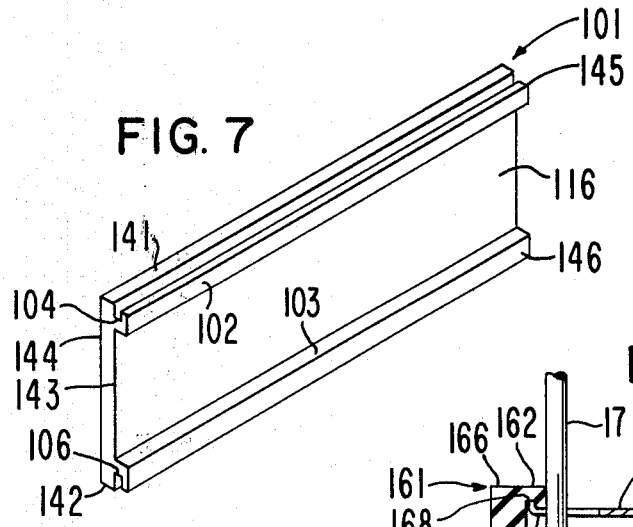
FIG. 7 is a perspective view of one preferred embodiment of the form board of the present invention.
Figure 8:
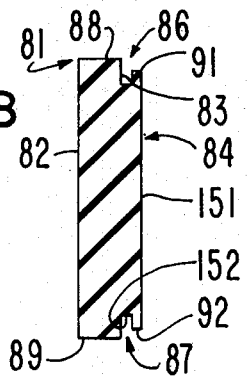
FIG. 8 is a cross-sectional side view of another preferred embodiment of the form board.
Figure 9:
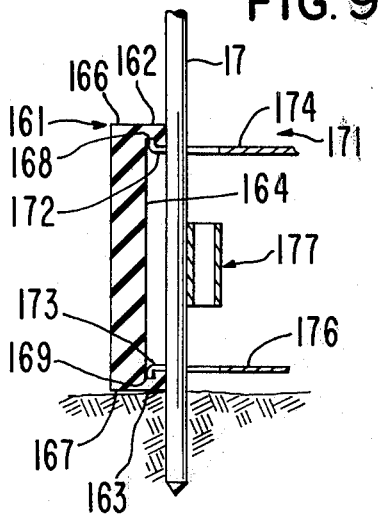
FIG. 9 is a cross-sectional side view of another preferred embodiment of the form board, illustrating its use with another preferred embodiment of the U-shaped spring clip, which is also partially illustrated in cross-sectional side view.

As will become more apparent from the following description of various embodiments of the U-shaped spring clip and channelled form board of the present invention, the U-shaped spring clip 23 can be used with commonly available bender boards to construct molding forms by arranging the arms 24, 26 to span the longitudinal edges 28 and 29 of the form boards 21 and grip the side 22 defining the reference surface. FIG. 6 illustrates such an embodiment of the U-shaped spring clip. However, employing form boards constructed in accordance with the present invention having channels near both longitudinal edges on the side opposite that defining the reference surface, such as illustrated in FIGS. 7 through 9, permits the spring clips 23 to grip the form boards without obstructing either the reference surface side 22 or the top and bottom edges 28 and 29 of the form boards 21.

Figure 2:
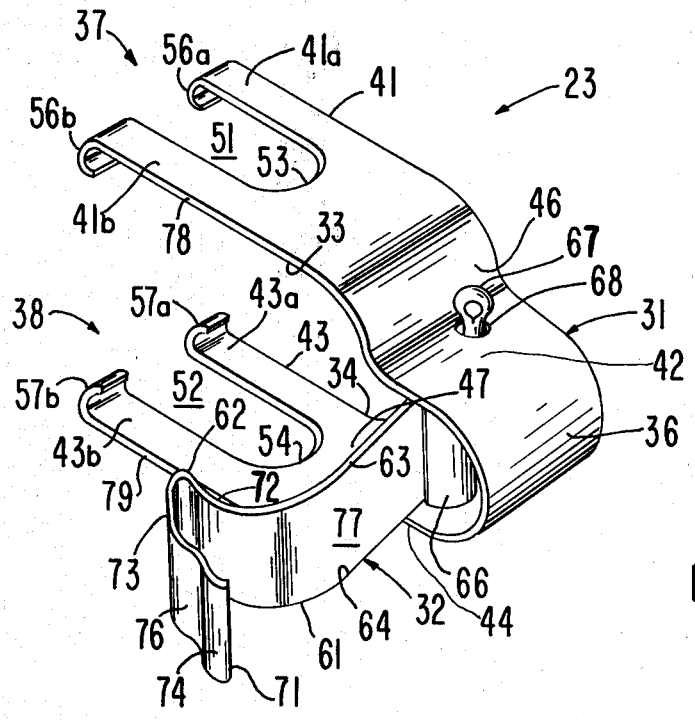
FIG. 2 is a perspective view of one preferred embodiment of the U-shaped spring clip of the present invention.

One preferred embodiment of the generally U-shaped spring clip 23 of the present invention is illustrated in FIG. 2. Such clip is fabricated from metal and includes a generally U-shaped clip 31 that works with a pivotally mounted curved flat spring 32 to hold a form board in place relative to an anchored support stake. The U-shaped clip 31 includes a pair of flat arms 33 and 34 joined together at one of their ends in a spaced apart relationship by a curved web member 36. Each of the arms 33, 34 extends from the web member to a free end 37 and 38, respectively.

Both of the arms 33 and 34 have longitudinally spaced offset flat end segments 41, 42 and 43, 44, respectively, with the offset flat end segments of each arm joined together by one of the S-curved central segments 46 and 47. Corresponding flat end segments of the arms 33 and 34, namely, corresponding end segments 41 and 43 and corresponding end segments 42 and 44, extend in spaced apart parallel planes, with the corresponding flat end segments 42 and 44 joined to the curved web member 36 closer together than the corresponding flat end segments 41 and 43 defining the free ends 37 and 38 of the arms. The corresponding flat end segments 42 and 44 are spaced apart a distance that permits the curved flat spring 32 to be pivotally mounted between them with the width of the flap spring extending between the segments so that the flat spring is held centrally between the spaced arms. The distance separating the corresponding flat end segments 41 and 43 is determined by the form board to be held by the arms 33 and 34. If common bender boards are used to construct the molding form, the flat end segments 41 and 43 are spaced apart a sufficient distance to permit the bender boards to be placed between the arms 33 and 34 with the width dimension of the bender board extending between the arms 33 and 34. An example of such bender board and spring clip arrangements is illustrated in FIG. 6. On the other hand, if channelled form boards of the present invention are used to construct the molding form, such as one of the embodiments illustrated in FIGS. 7 through 9, the flat end segments 41 and 43 are spaced apart only the distance for gripping the channels of the form boards. FIGS. 3, 4 and 9 illustrate examples of such U-shaped spring clip and channelled form board arrangements.

To support the U-shaped spring clip 23 at an anchored support stake, the arms 33 and 34 have apertures 51 and 52 cut in them, respectively, with one aperture located in each of the flat end segments 41 and 43 defining the free ends 37 and 38 of the arms. The apertures 51 and 52 are located in the corresponding flat end segments 41 and 43 in registration and are of a size that allows an anchored support stake to pass through the registered apertures 51 and 52 along a line that is perpendicular to the two flat end portions 41 and 43. In the preferred embodiments of the U-shaped spring clip 23, the apertures 51 and 52 are elongated slots centrally located in the corresponding flat end portions 41 and 43. Each slot 51 and 52 extends from a closed end 53 and 54, respectively, to an opening at the free end 37 and 38 of each arm 33 and 34 to form in each arm a pair of spaced apart coplanar parallel fingers 41*a*, 41*b* and 43*a*, 43*b*. However, as will be explained in further detail hereinbelow with reference to FIGS. 4A and 4B, the apertures 51 and 52 can take other forms such as circular holes in the flat end segments 41 and 43.

Regardless of the configuration of the apertures 51 and 52, they have a dimension in the direction of the width of the respective arms 33 and 34, that is just large enough to permit the apertures 51 and 52 to receive an anchored support stake. With the apertures 51 and 52 cut in this manner, the anchored support stake fits snugly, for example, between the two sets of parallel fingers 41*a*, 44*b* and 43*a*, 43*b*. The snug fit prevents the U-shaped spring clip 23 from moving relative to the support stake. This can be best understood by reference to FIG. 1. If the apertures are considerably larger than the received support stake 17, the spring clip 23 can be moved along the length of the form board 21. Also, the spring clip 23 may rotate about its axis of symmetry when the flat spring 27 is stressed to bear against the anchored support stake 17 to hold the form board 21 securely in place relative to the stake. Either one of those movements of the spring clip 23 can lead to mispositioning of the form board and damaging of the molding form components.

To grip the form board, appendages 56*a*, 56*b*, 57*a* and 57*b* are respectively joined to the fingers 41*a*, 41*b*, 43*a* and 43*b* to form a hook latch with each finger at the free ends 37 and 38 of the arms 33 and 34. The appendaged hook latches may be curved as illustrated in FIG. 2 or at a sharp angle relative to the fingers as illustrated in FIG. 9. Depending on the type of form board used with the U-shaped spring clip, the appendaged hook latches of the spaced apart arms 33 and 34 may face each other as illustrated in FIG. 2 or may face away from each other as illustrated in FIG. 9. The appendage hook latches 56*a*, 56*b*, 57*a* and 57*b* serve to grip the form board that is to be held in place relative to an anchored support stake.

In its preferred form, the U-shaped clip 23 is a unitary piece of metal of a thin gauge so that the integral S-curved central portions 46 and 47 and flat end segments 41 and 43 of the arms 33 and 34 form a resilient structure that permits the flat end portions 41 and 43 to be displaced toward and away from each other. The resilient characteristic of the structure assists the hook latches 53*a* and 53*b*, and 54*a* and 54*b* in holding a gripped form board firmly in place.

In the U-shaped spring clip embodiment illustrated in FIG. 2, the flat spring 32 is curved lengthwise to form a first bend 61 and a second reverse bend 62, which together define a generally S-shape. Spring 32 is pivotally mounted between the flat end segments 42 and 44 of the U-shaped clip 23 to pass centrally between the spaced apart flat arms 33 and 34, with the plane of the spring defined by edges 63 and 64 transverse to the planes of the spaced apart flat arms. One end of the flat spring 32 is folded on itself to define a hinge joint 66 for pivotally mounting the flat spring between the flat end segments 42 and 44. A cotter key 67 serves as a hinge pin and is inserted for this purpose through registered apertures 68, the cotter key 67 being held in place by its ends bearing against the outer surfaces of the arms 33 and 34.

The S-shaped flat spring 32 extends along a curved path from the hinge joint 66, through the first bend 61, reverses at the second bend 62 and terminates at the free end 71. The second bend 62 is formed by converging spring segments 72 and 73 that together define a resilient wedge structure having a wedge edge formed by the second bend 62. The face 74 of the wedge formed by the converging spring segment 73 extending between the free end 71 and the second bend or wedge edge 62 defines a load bearing surface that faces away from the other converging spring segment 72. The wedge face 74 has a recess 76 extending across its width for seating an anchored support stake passing through the slots 51, 52 of the arms 33, 34.

The curved flat spring segment 77 extending between the hinge joint 66 and the second bend or wedge edge 62 defines an arc having a curvature such that the distance from the first bend 61 to a line extending between the hinge joint 66 and the recess 76 is greater than one-half the width of the arms 33, 34. Consequently, the curved flat spring segment 77 will extend outside the plane defined by the aligned edges 78 and 79 of the spaced apart arms 33 and 34, when the flat spring 32 is positioned to bear against an anchored support stake extending through the slots 51 and 52. This enables the curved flat spring 32 to be conveniently disengaged from the stake by inserting a rod or other implement in the clearance between the curved flat spring 32 and adjacent edges 78 and 79 of the arms, and prying against the edges.

Figure 3A:
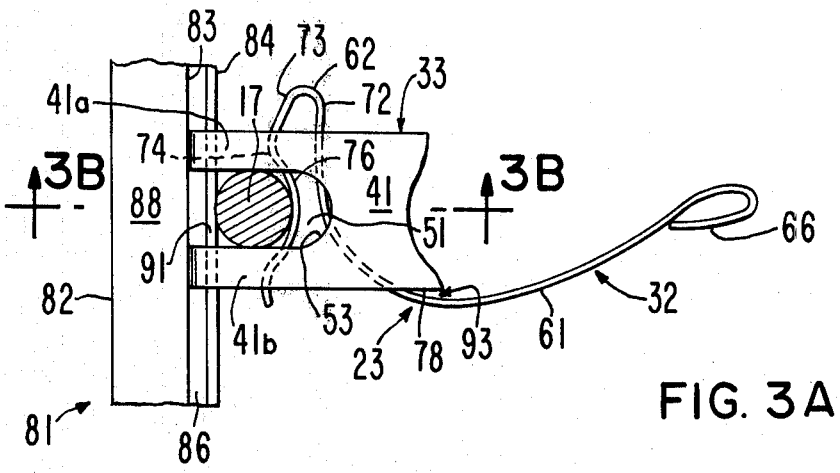
FIGS. 3A and 3B are partial top and cross-sectional side views, respectively, of the U-shaped spring clip embodiment of FIG. 2, illustrating its use in a molding form constructed with form boards of the kind illustrated by FIG. 8.
Figure 3B:
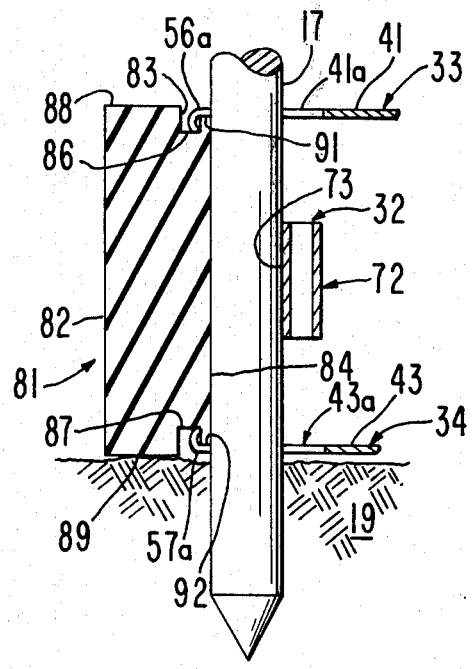

Referring now to FIGS. 3A and 3B, the U-shaped spring clip 23 described above with reference to FIG. 2 is illustrated as arranged to hold a form board 81 securely in place relative to a support stake 17 anchored in the ground 19. The form board 81 illustrated in FIGS. 3A and 3B is an embodiment of the channelled form board illustrated in FIG. 8, which will be described in further detail hereinbelow. Briefly, however, form board 81 has a flat side 82 forming a reference surface that faces towards and defines the border of the concrete deck structure to be constructed. Joined to the opposite side 83 of the form board 81 is a T-shaped structure 84 that extends centrally from the side 83 to define a pair of open channels 86 and 87 longitudinally extending along the form board 81 near its opposite top and bottom edges 88 and 89.

To secure the form boards 81 in place relative to the anchored support stakes 17, each spring clip 23 is positioned with an anchored support stake 17 passing through the clip's slots 51 and 52 located between the fingers 41*a*, 41*b* and 43*a*, 43*b* of the arms 33 and 34. For form boards having outwardly opening channels as illustrated in FIGS. 3A and 3B, the flat end segments 41 and 43 are separated a distance slightly less than the distance separating the openings defined by the vertically spaced open channels 86 and 87. The appendaged hook latches 56*a*, 56*b*, 57*a* and 57*b* are seated in the channels to grip the form board 81 by forcing the flat end segments 41 and 43 apart, positioning the form board 81 with the channels 86 and 87 located to receive the hook latches, and releasing the flat end segments to seat the hook latches in the channels. With the hook latches seated in the channels 86 and 87, the fingers 41*a*, 41*b*, 43*a* and 43*b* of the flat end segments 41 and 43 bear against the edges 91 and 92 of the T-shaped structure defining the channels 86 and 87. As described hereinabove with reference to FIG. 2, this bearing against the form board 81 assists the spring clip 23 in holding the form board 81.

With the form board 81 gripped by the appendaged hook latches 56*a*, 56*b*, 57*a* and 57*b*, the S-shaped flat spring 32 is pivoted about its hinged joint 66 to bring its wedge defining converging spring segment 73 into contact with the anchored support stake 17, with the stake 17 abutting the form board 81 along the facing surface of the T-shaped structure 84. In U-shaped spring clip embodiments for holding form boards against anchored support stakes as illustrated in FIGS. 3A and 3B, the unstressed span of the S-shaped flat spring 32 from the hinge joint 66 to the wedge edge 62, is selected to allow the abutted anchored support stake 17 and gripped form board 81 to clear the wedge edge 62. However, the unstressed span of the flat spring 32 from the hinge joint 66 to the load bearing surface at the recess 76 for seating the anchored support stake 17 is greater than that which would allow the recess 76 to stand clear of the abutted anchored support stake 17 and gripped form board 81.

The gripped form board 81 is secured to the anchored support stake 17 by forcing the flat spring 32 against the stake with sufficient force to cause the resilient wedge formed by the converging spring segments 72 and 73 to be stressed enough to allow the support stake 17 to be seated in the recess 76. This can be accomplished conveniently by striking the curved flat spring 32 in the vicinity of the bend 61 with a strong blow. With the anchored support stake 17 seated in the recess 76, the flat spring 32 remains stressed to generate a spring force that acts against the anchored support stake 17 to force the hinged joint 66 away from the stake and thereby cause the attached flat arms 41 and 43 to draw the gripped form board 81 firmly against the anchored support stake.

Several advantages are realized by the molding form embodiment illustrated by FIGS. 3A and 3B. Because the anchored support stake 17 bears firmly against the entire width of the form board 81, the form board does not bend in its plane as a result of the forces exerted by the spring clip 23 near top and bottom edges 88 and 89 of the form board 81. Typically, form boards are thin flexible members, usually having a thickness of about ¼ inch, and tend to bend under the influence of locally applied forces. Another advantage accruing to the molding form embodiment illustrated by FIGS. 3A and 3B is the U-shaped spring clip 23 can be removed after the concrete mixture is poured in the molding form to form the concrete deck structure. The concrete mixture exerts a force against the form boards 81 that urges it against the anchored support stake 17. Consequently, the U-shaped spring clip is not required to hold the form board 81 in place after the concrete is poured.

Each spring clip 23 is removed by forcing its flat spring 32 out of engagement with the anchored support stake 17. Because the curved flat spring segment 77 of each extends outside the plane defined by the aligned edges 78 and 79 of the spaced apart arms 33, 34 (FIG. 2), a space 93 exists between the engaged flat spring 32 and the aligned edges. Inserting a rod in the space 93 and prying against the edge 78 of the arm 33 forces the flat spring 32 out of engagement with the anchored support stake 17. Following the disengagement of the flat spring 32, the flat end segments 41 and 43 are forced apart to unseat the appendaged hook latches 56*a*, 56*b*, 57*a* and 57*b* from the channels 86 and 87, and the U-shaped spring clip 23 is withdrawn from the anchored support stake 17. After the concrete mixture has cured, the anchored support stakes 17 are withdrawn from the ground 19 and the form boards removed from the border of the constructed concrete deck structure.

Figure 4A:
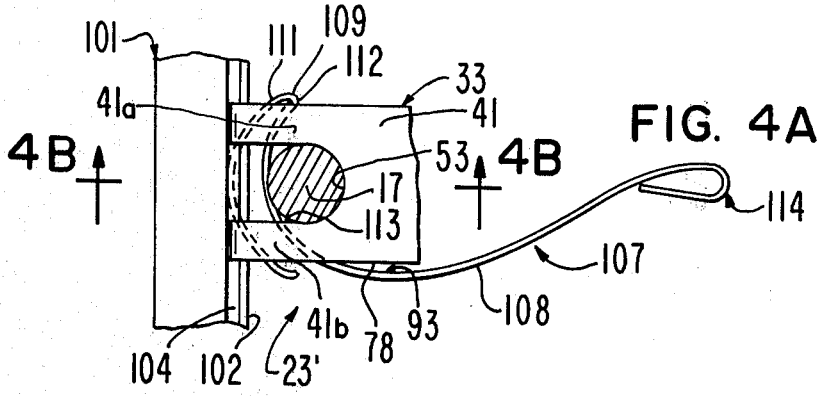
FIGS. 4A and 4B are partial top and cross-sectional side views, respectively, of another preferred embodiment of the U-shaped spring clip, illustrating its use in a molding form constructed with form boards of the kind illustrated by FIG. 7.
Figure 4B:
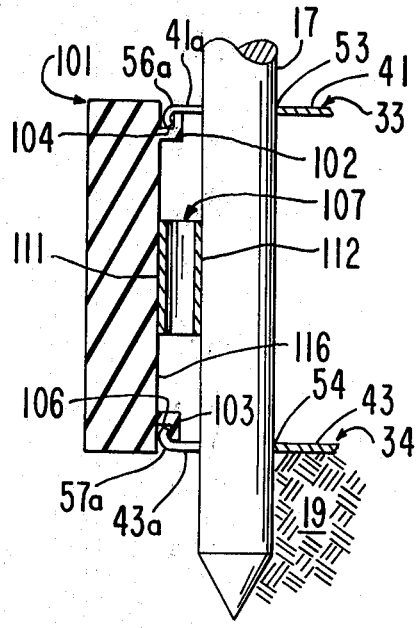

FIGS. 4A and 4B illustrate another U-shaped spring clip 23' embodiment of the present invention, arranged to hold a form board 101 securely in place relative to an anchored support stake 17. The form board 101 illustrated in FIGS. 4A and 4B is an embodiment of the channelled form board illustrated in FIG. 7, which will be described in further detail below. Such form board is similar to that illustrated in FIG. 8, differing in that a pair of separate, spaced apart L-shaped structures 102 and 103 define the longitudinally extending channels 104 and 106 gripped by the U-shaped spring clip. In all other respects, the construction of the form board 101 illustrated in FIGS. 4 and 7 is similar to that of the form board 81 illustrated in FIGS. 3 and 4.

The U-shaped spring clip 23' illustrated in FIGS. 4A and 4B is similar to the spring clip 23 illustrated in FIGS. 2 and 3, differing only in the configuration of the curved flat spring 107. Elements of the spring clip 23' embodiment illustrated by FIGS. 4A and 4B that are like the elements of the spring clip 23 embodiment illustrated by FIGS. 2 and 3 are identified by the same reference numbers.

In the U-shaped spring clip embodiment illustrated in FIGS. 4A and 4B, the flat spring 107 is curved lengthwise to form a first bend 108 and a second reverse bend 109, which together define a generally S-shaped flat spring 107. The second reverse bend 109 is formed by converging spring segments 111 and 112 that together define a resilient wedge structure having a wedge edge formed by the second bend 109.

U-shaped spring clip 23' secures a gripped form board 101 relative to an anchored support stake 17 by forcing the resilient wedge structure formed by the flat spring 107 at the wedge edge 109 between the form board 101 and the stake 17. Consequently, the faces of both converging spring segments 111 and 112 form load bearing surfaces for engaging the form board 101 and the support stake 17, with the converging spring segment 112 having a concave seat 113 for receiving the stake 17.

The unstressed span of the S-shaped flat spring 107 from its hinge joint 114 to the wedge edge 109, is selected to pass between the gripped form board 101 and the anchored support stake 17, with the stake seated against the closed ends 53 and 54 of the slots defined in the spaced apart arms 33 and 34. However, the unstressed span of the resilient wedge portion of the flat spring 107 from the seat 113 of the converging spring segment 112 to the corresponding location along the converging spring segment 111, is greater than that which would allow the wedge portion of the flat spring 107 to pass between the gripped form board 101 and the anchored support stake 17.

The gripped form board 101 is secured to the anchored support stake 17 by positioning the flat spring 107 with the wedge edge 109 between the gripped form board 101 and the anchored stake 17. The converging spring segment 111 bears against the surface 116 of the form board 101 extending between the spaced apart L-shaped structures 102 and 103 and the converging spring segment 112 bears against the anchored stake 17 seated against the arms 33 and 34. A force is applied to the flat spring 107 that causes the converging spring segments 111 and 112 to be stressed enough to allow the resilient wedge to pass between the gripped form board 101 and anchored stake 17 and position the stake 17 in seat 113. The stressed flat spring 107 generates a spring force that acts against the anchored support stake 17 to force the gripped form board 101 away from the stake and to draw the hinged joint 114 towards the stake. This draws the arms 33 and 34 of the U-shaped spring clip 23' firmly against the anchored stake 17 and forces the gripped form board 101 firmly against the hook latches 56*a*, 56*b*, 57*a* and 57*b*. To ensure that the gripped form board 101 is held securely in place relative to the anchored stake 17, the length of the fingers 41*a*, 41*b*, 43*a* and 43*b* (or length of the slots 51 and 52) are selected for the S-shaped flat spring 107 so that the flat spring 107 remains heavily stressed as it bears against the anchored support 17 at the closed ends 53 and 54 of the slots 51 and 52 and the form board 101 gripped by the hook latches.

In embodiments of the U-shaped spring clip 23' having a flat spring 107 that passes between the anchored support stake and gripped form board to support the form board in place, the open-ended slots 51 and 52 can be replaced by a single closed aperture in each of the arms 33 and 34. This would eliminate the fingers 41*a*, 41*b*, 43*a* and 43*b*, and a single appendaged hook latch would be located at the free end of each of the arms 33, 34. The size of the closed aperture need only be large enough to allow support stakes to pass through it. For example, in the U-shaped spring clip embodiment illustrated in FIGS. 4A and 4B, circular holes would be used. The holes would be located at the closed end of the slots 51 and 52 and would be of a diameter slightly larger than the diameter of the support stake 17.

Figure 5:
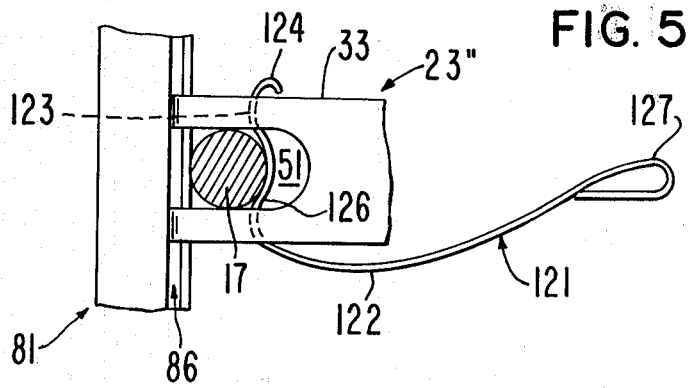
FIG. 5 is a partial top view of another preferred embodiment of the U-shaped spring clip, illustrating its use with a molding form.

Another embodiment of the U-shaped spring clip of the present invention is illustrated in FIG. 5. In this embodiment, the U-shaped spring clip 23'' is constructed the same as the U-shaped spring clip 23 illustrated in FIG. 2, except the S-shaped curved flat spring 32 of spring clip 23 is replaced with a curved flat spring 121 having a single spring force creating bend 122 in its length. The U-shaped clip 23'' holds a gripped form board in place relative to anchored support stakes in the same manner as illustrated in FIGS. 3A and 3B and can be used in place of the U-shaped spring clip 23 illustrated in FIGS. 3A and 3B. More specifically, appendaged hook latches at the free ends of the arms of the U-shaped spring clip 23'' (upper arm 33 being illustrated in FIG. 5) are seated in channels to grip the form board 81 (upper channel 86 being illustrated in FIG. 5). A segment 123 of the flat spring 121 close to the free end 124 of the flat spring forms a load bearing surface along its face and defines a recess 126 for seating the anchored support stake 17.

As in the U-shaped spring clip embodiment illustrated in FIGS. 3A and 3B, the gripped form board 81 is held securely against the anchored support stake 17. This is accomplished by stressing the curved flat spring 121 with sufficient force to seat the anchored stake 17 in the recess 126. With the anchored stake 17 seated in the recess 126, the curved flat spring 121 remains stressed to generate the spring force that acts against the anchored support stake 17 to draw the gripped form board 81 firmly against the stake. The curved flat spring 121 remains stressed because the unstressed span from the hinge joint 127 to the load bearing surface at the recess 126 is greater than that which would allow the recess 126 to stand clear of the abutted anchored support stake 17 and gripped form board 81. To facilitate positioning the curved flat spring 121, its unstressed span from the hinge joint 127 to the free end 124 is selected to allow the abutted anchored support stake 17 and gripped form board 81 to clear the free end 124. This construction allows the curved flat spring 121 to be positioned with its recess 126 at the anchored support stake 17 by gradually increasing the stress in the curved flat spring, hence, the force bearing on the support stake 17. By gradually increasing the stress, forces harmful to the molding form components are avoided. The constructions of the embodiments of the U-shaped spring clip illustrated by FIGS. 3 and 4 also incorporate this feature.

Referring to FIG. 6, the U-shaped spring clip 23 of FIG. 2 is illustrated as employed at a junction 131 of contiguous commonly available bender boards 132. To hold the contiguous bender boards 132 in place, a support stake 17 is anchored at the position of the junction 131 of the boards. The corresponding fingers **41*a* and 43*a* and appendaged hook latches (not visible) of the flat arms 33 and 34 grip the longitudinal edges 133 and 134 of one of the bender boards 132 while the corresponding fingers 41*b* and 43*b* and appendaged hook latches of the flat arms grip the longitudinal edges 133 and 134 of the other contiguous bender board. A buttress 136 in the form of a flat board is placed between the anchored support stake 17 and the contiguous bender boards 132. The buttress 136 prevents the bender boards 132 from bowing at the junction 131 or escaping the hold of the U-shaped spring clip 23. The buttressed contiguous form boards 132 are held firmly against the anchored support stake 17 by the spring force generated by the S-shaped flat spring 32 that is stressed to bear against the support stake 17**.

Reference is now made to FIGS. 7 through 9, which illustrate embodiments of the flexible form board. As generally described hereinbefore, a form board particularly useful in the present invention has channels on opposite sides of its longitudinal center line. For example, in the embodiment of FIG. 7, the form board 101 has a pair of separate L-shaped structures 102 and 103 that extend the entire length of the form board 101 near opposite longitudinal edges 141 and 142. In the form board 101 illustrated in FIG. 7, the separate L-shaped structures 102 and 103 define channels 104 and 106 that open away from each other. The L-shaped structures 102 and 103 are joined to the side 143 of the form board 101 opposite the side 144 form the flat reference surface employed to define the border of molded structures. In addition, if the form board 101 is to be used with U-shaped spring clips 23' of the type illustrated in FIGS. 4A and 4B, the L-shaped structures 102 and 103 are preferably spaced apart a distance that is sufficient to permit the S-shaped flat spring 107 to be located between them and against the surface 116.

FIG. 8 illustrates another embodiment of the form board. The form board 81 of that embodiment is similar to form board 101 illustrated in FIG. 7, differing in that a T-shaped structure 84 forms the channels 86 and 87 instead of separate L-shaped structures. The T-shaped structure 84 extends the length of the form board 81 and includes a bar member 151 centrally joined to a stem member 152. The stem member 152 of the T-shaped structure 84 is joined at and extends perpendicularly from the side 83 of the form board 81, opposite the reference surface defining side 82.

In both form board embodiments 101 and 81 illustrated by FIGS. 7 and 8, respectively, it is preferred to locate the channel defining structures so that the U-shaped spring clips are not above the plane of the longitudinal board edges when they grip the form boards. As brought out above, such construction facilitates assembly, constructing and dismantling of molding forms. In the form board 101 illustrated in FIG. 7, the separate L-shaped structures 102 and 103 are joined to the side 143 of the form board at locations that place the edges 145 and 146 a distance inside the longitudinal edges 141 and 142 of the form board 101 that permits the U-shaped spring clips to be positioned to grip the channels without breaking the planes defined by the edges 141 and 142. Similarly, the ends 91 and 92 of the bar member 151 of the form board 81 illustrated in FIG. 8 terminate a distance below the proximate edges 88 and 89 of the form board that permits the U-shaped spring clips to so positioned.

FIG. 9 illustrates additional embodiments of the form board and U-shaped spring clip of the present invention. The form board 161 includes separate L-shaped structures 162 and 163 joined to a side 164 of the form board at its longitudinal edges 166 and 167 to define channels 168 and 169 longitudinally along the form board 161 that open inwardly. To hold the form board 161 in place relative to an anchored support stake 17, a U-shaped spring clip 171 is provided. Such U-shaped spring clip 171 is constructed like the U-shaped spring clip 23 illustrated in FIG. 2, except the appendage hook latches 172 and 173 carried by the spaced apart arms 174 and 176 face away from each other instead of towards each other. In addition, the arms 174 and 176 are spaced apart a distance slightly greater than the distance separating the openings into the channels 168 and 169 so that the arms are stressed to bear against the L-shaped structures 162 and 163 when the hook latches 172 and 173 are seated in the channels. As described hereinbefore, this aids the U-shaped spring clip 171 in gripping the form board 161 as the form board is drawn against the anchored support stake 17 by a force created by the curved flat spring 177 bearing against the stake.

The flexible form board structures illustrated in FIGS. 7 through 9 preferably are fabricated as integral structures of plastic by extrusion processes. However, the flexible form board can be constructed by attaching separate channel defining structures to a flat form board with suitable fasteners. In addition, it is not necessary that the channels extend the entire length of the form board. A plurality of short L-shaped (or T-shaped) brackets can be fastened to the form board at intervals to define interrupted channels longitudinally along the same.

Although the invention has been described in connection with preferred embodiments thereof, it will be appreciated by those skilled in the art that various changes and modifications can be made without departing from the spirit of the invention. Therefore, it is intended that the coverage of the invention be limited only by the language of the claims and its equivalent.

I claim:

1. A spring clip for holding a form board in position relative to a support stake comprising:

a pair of spaced flat arms, each arm having a free end and an opposite end and defining an aperture in the plane of said arm proximate said free end, the apertures of the arms in registration and of a size to allow the support stake to pass through the pair of arms;

a hook latch at the free end of each arm for holding the form board;

a web joined to the opposite ends of the pair of arms to join them together; and a flat spring having at least one bend in its length the flat spring having one end pivotally mounted to the arms proximate the web and extending to an opposite free end so that said flat spring passes between the spaced arms and has a segment defining a load bearing surface in the plane of said flat spring passes between the spaced arms and has a segment defining a load bearing surface in the plane of said flat spring proximate the free end, that extends transverse to said arms, said flat spring having an unstressed span from its pivot end to the load bearing surface so that when said flat spring is positioned between the arms with the form board adjacent the hook latches and the support stake passing through the apertures it can be stressed to have said load bearing surface bearing against the support stake with sufficient spring force in a direction transverse to said support stake to hold said form board firmly against the adjacent hook latches and in place relative to said support stake.

2. The spring clip according to claim 1 wherein the flat spring has two bends in its length forming an S-shaped flat spring, the bend closest the free end of the flat spring formed by two segments of said flat spring converging to define a resilient wedge, at least one of the converging segments of the flat spring having a face defining the load bearig surface.

3. The spring clip according to claim 2 wherein the wedge defining converging segment of the flat spring closest the free end of said flat spring has a face that defines the load bearing surface which faces away from the pivot end of said flat spring; and the length of each arm, the location of the aperture in each arm, and the unstressed span of the S-shaped flat spring are selected so that said flat spring can be stressed to have the load bearing surface engage the support stake positioned between the form board and flat spring with sufficient spring force to hold said form board firmly against and between the adjacent hook latches and said support stake.

4. The spring clip according to claim 2 wherein the load bearing surface has two surface portions with one surface portion defined by a face of each of the wedge defining converging segments of the flat spring; and the length of each arm, the location of the aperture in each arm, and the unstressed span of the S-shaped flat spring are selected so that said flat spring can be stressed to pass between the support stake and the form board with the two portions of the load bearing surfaces respectively engaging facing surfaces of said support stake and said form board with sufficient spring force to hold said form board firmly against the adjacent hook latches and to hold the apertured arms firmly against said support stake.

5. The spring clip according to claim 2 wherein the bend of the S-shaped flat spring closest to the pivot end follows an arc that extends beyond a plane defined by adjacent edges of the spaced flat arms when said flat spring is positioned to hold the form board against the support stake.

6. The spring clip according to claim 5 wherein said hook latches extend from the arms towards each other.

7. The spring clip according to claim 6 further comprising a hinge pivotally joining the S-shaped flat spring to the spaced flat arms, the hinge including a hinge joint fastened at the pivoted end of said S-shaped flat spring and a hinge pin fastened to the spaced flat arms to extend between said arms through the hinge joint.

8. The spring clip according to claim 7 wherein each flat arm has offset segments at opposite ends joined together by a curved central segment, the offset segments at the free ends of the spaced arms spaced further apart than the offset segments at the pivoted ends of the spaced arms.

9. The spring clip according to claim 8 wherein the aperture defined by each arm is a slot extending centrally and longitudinally along a length of the arm from a closed end to an open end at the free end of said arm to form a pair of parallel fingers, each finger having an appendaged hook latch at the free end.

10. The spring clip according to claim 9 wherein the bend closest the free end of the S-shaped flat spring is formed by two segments of said flat spring converging to define a resilient wedge, the wedge defining converging segment of the flat spring closest the free end of said flat spring having a face that defines the load bearing surface which faces away from the pivot end of said flat spring; and the length of each finger and the unstressed span of the S-shaped flat spring are selected so that said flat spring can be stressed to have the load bearing wedge surface engage the support stake positioned between the form board and flat spring force with sufficient spring to hold said form board firmly against and between the adjacent hook latches and said support stake.

11. The spring clip according to claim 9 wherein the bend closest the free end of the flat spring is formed by two segments of said flat spring that converge to define a resilient wedge; the load bearing surface has two surface portions with one surface portion defined by a face of each wedge defining converging segment of the flat spring; and the length of each finger and the unstressed span of the S-shaped flat spring are selected so that said flat spring can be stressed to pass between the support stake and the form board with the two portions of the load bearing surface respectively engaging facing surfaces of said support stake and said form board with sufficient spring force to hold said form board firmly against the adjacent hook latches and to hold said support stake firmly against the respective arms at the closed ends of the slots.

12. The spring clip according to claim 1 wherein each of said hook latches is an appendage with said appendages extending from the arms towards each other.

13. The spring clip according to claim 1 wherein the aperture defined by each arm is a slot extending centrally along the length of the arm from a closed end to an open end at the free end of said arm to form a pair of parallel fingers, each finger having an appendaged hook latch at the free end.

14. The spring clip according to claim 13 wherein each flat arm has offset segments at opposite ends joined together by a curved central segment, the offset segments at the ends of the spaced arms forming the parallel fingers spaced further apart than the offset segments at the pivot ends of the spaced arms, and the appendaged hook latches extend from the fingers formed in each arm towards the appendaged hook latches extending from the fingers formed in the other arm.

15. The spring clip according to claim 1 for holding a form board having an L-shaped structure joined to one side of said form board proximate each opposite longitudinal edge, each L-shaped structure joined to the form board to form therewith an open channel for receiving the hook latch proximate the longitudinal edge of the form board; wherein the flat arms are spaced a distance corresponding to the distance separating the open channels defined by the joined form boards and L-shaped structures; and the length of each arm, the location of the aperture in each arm and the unstressed span of the flat spring are selected so that the form board is held in place relative to the support stake when the hook latches are inserted in the open channels and said flat spring is positioned between the arms with its load bearing surface bearing against said form board and said support stake.

16. A spring clip for holding a form board in position relative to a support stake comprising:

a generally U-shaped member having a pair of spaced flat arms joined at one of their adjacent ends by a web and having opposite adjacent free ends, each arm having offset segments at opposite ends joined together by a curved central segment so that offset segments of the arms joined by the web are closer together than the offset segments at the free ends, the offset segment at the free end of each of said arms defining an aperture in the plane of the offset segment with the apertures of the arms in registration and of a size to allow the support stake to pass through the arms, the U-shaped member constructed of a spring material permitting the arms to be displaced towards and away from each other;

a hook latch appendage integrally joined to the free end of each arm for holding the form board; and a flat spring having at least one bend in its length, the flat spring having one end pivotally mounted to the offset segments of the arms joined by the web and extending to an opposite free end so that the plane of said flat spring is transverse to said arms, the flat spring having a segment defining at least one load bearing surface in the plane of said flat spring proximate the free end, and the flat spring having an unstressed span from its pivot end to the load bearing surface such that when said flat spring is positioned between the arms with the form board adjacent the appendaged hook latches and the support stake passing through the apertures it can be stressed to have said load bearing surface bear against the support stake with sufficient spring force in a direction transverse to said support stake to hold said form board firmly against the adjacent hook latches and in place relative to said support stake.

17. A spring clip according to claim 16 wherein the offset segment at the free end of each arm includes a pair of parallel fingers spaced apart to define a slottype aperture extending longitudinally of the form a closed end defined by said arm to an open end at the free end of said arm, each finger is integrally joined at its free end to an appendage to form a hook latch, the appendages extend from the fingers of each arm towards the appendages extending from the fingers of the other arm.

18. A form for establishing a reference surface transverse to a plane along a predetermined line comprising:

a form board having longitudinally extending sides and edges with said sides defining opposite first and second longitudinally extending surfaces, the first surface being flat to form said reference surface, the form board positioned along said predetermined line with one of its longitudinal edges adjacent to said plane so that the reference surface is transverse to the plane;

a plurality of support stakes fixed in place to extend from said plane along a stake line parallel to and spaced from the predetermined line, the form board and support stakes relatively positioned with the reference surface defined by said form board facing away from said support stakes; and a generally U-shaped spring clip supported by each support stake, each U-shaped clip having a pair of spaced arms and a flat spring, the pair of arms joined at one of their adjacent ends by a web and having opposite adjacent free ends, each free end having an appendage forming a hook latch, each arm of the clip defining an aperture in the plane of the arm with the apertures of the pair of arms in registration, the flat spring having at least one bend in its length and pivotally mounted to the arms proximate the web so that the plane of said flat spring is transverse to the planes of said arms, each U-shaped clip positioned with a support stake passing through the registered apertures and the appendaged hook latches gripping the form board at opposite sides of a longitudinal center line of said form board, the flat spring positioned between the spaced arms and stressed to bear against the support stake in a direction transverse thereto to hold said form board firmly against the appendaged hook latches and in place relative to said support stake.

19. The form according to claim 18 including at least two longitudinally aligned contiguous form boards defining a joint therebetween further comprising a buttress spanning the joint along the second surfaces of the contiguous form boards, the stressed flat spring producing a force holding the buttress against the second surfaces of the contiguous form boards.

20. The form according to claim 19 wherein the support stake is located between the flat spring and form board so that said flat spring engages said support stake, the flat spring is stressed to hold the form board firmly against the support stake, and the buttress is positioned between the form board and the support stake to be held against said form board by said support stake.

21. The form according to claim 18 wherein the form boards are flexible along their lengths.

22. The form according to claim 18 wherein each form board has an L-shaped structure joined to the side of the form board defining the second surface proximate each longitudinal edge of said form board, each L-shaped structure joined to the form board to form with the second surface thereof an open channel for receiving the appendaged hook latch of the U-shaped spring clip proximate the longitudinal edge, the appendaged hook latches of the U-shaped spring clip seated in the open channel to grip the form board.

* * * * *